US007810273B2

(12) United States Patent
Koch et al.

(10) Patent No.: US 7,810,273 B2
(45) Date of Patent: Oct. 12, 2010

(54) FIREARM SIGHT HAVING TWO PARALLEL VIDEO CAMERAS

(76) Inventors: Rudolf Koch, Vogelrohrsheide 30, 48167 Muenster (DE); Peter Veerkamp, Kettelerstrasse 38, 48282 Emsdetten (DE); Franz-Josef Watermann, Hessenweg 24, 48268 Greven (DE)

( * ) Notice: Subject to any disclaimer, the term of this patent is extended or adjusted under 35 U.S.C. 154(b) by 584 days.

(21) Appl. No.: 11/908,077

(22) PCT Filed: Mar. 16, 2006

(86) PCT No.: PCT/EP2006/002428

§ 371 (c)(1),
(2), (4) Date: Sep. 7, 2007

(87) PCT Pub. No.: WO2006/097310

PCT Pub. Date: Sep. 21, 2006

(65) Prior Publication Data

US 2008/0163536 A1 Jul. 10, 2008

(30) Foreign Application Priority Data

Mar. 18, 2005 (DE) ..... 10 2005 013 117

(51) Int. Cl.
*F41G 1/00* (2006.01)

(52) U.S. Cl. ..... 42/111; 42/122; 42/142; 89/41.05

(58) Field of Classification Search ..... 42/111, 42/122, 130, 142; 89/41.05; 359/399
See application file for complete search history.

(56) References Cited

U.S. PATENT DOCUMENTS 4,027,159 A * 5/1977 Bishop ..... 250/338.1
4,695,256 A 9/1987 Eichweber et al.
4,786,966 A * 11/1988 Hanson et al. ..... 348/158
4,804,843 A * 2/1989 Hall ..... 250/330
4,811,093 A 3/1989 Giacometti et al.
4,970,589 A * 11/1990 Hanson et al. ..... 348/158
4,976,038 A * 12/1990 Nattrass ..... 42/136
5,272,514 A * 12/1993 Dor ..... 356/251
5,675,112 A 10/1997 Giry et al.
5,806,229 A 9/1998 Daz et al.
6,237,462 B1 * 5/2001 Hawkes et al. ..... 89/41.05
6,269,730 B1 * 8/2001 Hawkes et al. ..... 89/41.05
6,449,892 B1 * 9/2002 Jenkins ..... 42/1.01
6,679,158 B1 * 1/2004 Hawkes et al. ..... 89/41.05
6,729,223 B2 * 5/2004 De Lapasse ..... 89/41.17

(Continued)

*Primary Examiner*—Michael Carone
*Assistant Examiner*—Michael D David
(74) *Attorney, Agent, or Firm*—Greer, Burns & Crain, Ltd.

(57) ABSTRACT

A sighting mechanism for a firearm, including two video cameras, a video screen, a digital sighting distance meter, a sensor for measuring environment, cartridge and/or weapon parameters, a biometric sensor, a memory module for biometric data and/or munitions data and a digital computer. The video cameras are arranged parallel to each other to capture the target sighting field. The computer has video inputs and an image processing unit enabling the video image data to be superimposed in real time in a pixel precise manner in relation to the target field on the screen. The computer includes a ballistic computer which enables the target image to reproduce on the screen. A graticule arranged on the screen can be positioned automatically and in real time according to the incoming data, such that the position of the graticule in the target field corresponds to a real projectile point of impact.

27 Claims, 2 Drawing Sheets

U.S. PATENT DOCUMENTS 7,210,392 B2 * 5/2007 Greene et al. ..... 89/41.03
7,255,035 B2 * 8/2007 Mowers ..... 89/41.05
7,333,270 B1 * 2/2008 Pochapsky et al. ..... 359/634
2005/0066808 A1 * 3/2005 Hawkes et al. ..... 89/41.05
2006/0005447 A1 * 1/2006 Lenner et al. ..... 42/111
2009/0133572 A1 * 5/2009 Izraeli ..... 89/41.05

* cited by examiner

FIREARM SIGHT HAVING TWO PARALLEL VIDEO CAMERAS

BACKGROUND OF THE INVENTION

The present invention relates to a sighting mechanism for a firearm, having the following features:

a digital video camera that is arranged on a firearm parallel to its barrel and records a target sighting field, a video screen that is arranged in the sighting field of a marksman operating the firearm and displays a target image that is recorded by the video camera, a digital target distance meter, at least one sensor for detecting measurable environmental parameters, at least one sensor for detecting measureable cartridge and/or weapon parameters, at least one biometric sensor for recognizing a marksman handling the firearm, at least one memory module, in which encoded biometric data of at least one authorized marksman and/or ammunition data of ammunition that can be discharged by the firearm are/is stored; and a digital computer unit having input interfaces for the distance meter, for the sensors, and for the memory module, and having an output interface for the video screen, whereby, aside from the target image recorded by the video camera, the video screen displays an information for the marksman that supports the aiming and is calculated by the computer unit as a function of the data that is incoming by the means of the input interfaces.

With regard to firearms for large shooting distances, e.g., rifles for shooting distances of 1000 m and more, it is difficult to achieve high hitting accuracy using a solely optical sighting mechanism, such as a sighting telescope. This is due, in particular, to various influences having increasing impact with increasing shooting distance. One influence is that the projectile travels along a ballistic trajectory whose course deviates increasingly from an imaginary straight line between firearm and target with increasing shooting distance. In addition, e.g., the wind direction, wind velocity, air temperature, air pressure, and air humidity exert an influence on the trajectory of a projectile. The type of ammunition used also influences the trajectory of the projectile; moreover, for the same ammunition, the cartridge temperature and barrel temperature at the time of discharging the shot have a noticeable role for the course of the projectile's trajectory. For the reasons stated above, it is useful to design the firearm and its sighting mechanism such that a correction in accordance with the existing circumstances influencing the trajectory of the projectile can be made.

A sighting telescope for a weapon is evident from EP 0 966 647 B1. Therein, the sighting telescope is equipped with at least one micromotor and a laser beam telemeter that determines the distance between the marksman and the target disc and transmits this distance to a computer that stores the perpendicular of the trajectory of the bullet at said distance in its memory, whereby said computer triggers the micromotor as a function of the distance thus determined and of the perpendicular of the trajectory of the bullet at this distance. It is further provided that the sighting telescope is attached to a horizontal rotational axis such that it can be swiveled and that the micromotor is placed such that it can swivel the sighting telescope about said horizontal rotational axis in order to vary the angle of the sighting telescope with respect to the axis of the weapon on which the sighting telescope is to be used in order to correct the elevation or depression of a shot with respect to a zero point as a function of the distance thus determined and of the perpendicular to the trajectory of the bullet in order to thus vary the position of the reticule of the sighting telescope from the original target point to the target point provided for said distance. Moreover, it allows a second micrometer to be placed such that it allows the sighting telescope to be swiveled about a vertical axis in order to correct the angle of the trajectory towards the right and towards the left with regard to a zero point, and do so as a function of the wind velocity and/or the motion of the target disc.

The sighting telescope described therein required a high mechanical effort since, on the hand, it has to be so smooth-operating while being exactly connected to the weapon that it can be re-adjusted exactly by the micromotor or micromotors, and, on the other hand, withstands the recoil forces upon the discharge of a shot without being damaged. These requirements can be met only through a high fine-mechanical effort which renders the weapon and the corresponding sighting telescope very expensive. Moreover, it is possible to correct for only some of the influences interfering with the trajectory of the projectile such that the hitting accuracy is improved, but not yet optimal.

A digital sighting telescope mounted on a small firearm is known form DE 101 05 036 A1. This invention provides that a screen replaces or supplements the eyepiece of the sighting telescope. Moreover, various forms of graticule can be selected or faded-in in this digital sighting telescope, whereby each selected and faded-in graticule is centered in the middle of the image and upon readjustment remains in the original middle of the image and, upon a change of program, the new graticule is centered to the position of the previous graticule and therefore the holding point remains unchanged, whereby an image with shot-tested stored graticule can be accepted into obtain a program. In the case of multi-barreled weapons, this is carried out for each barrel. Moreover, the invention provides that the digital sighting telescope can be mounted on multiple weapons, whereby each weapon is shot-tested with each graticule and thus data is obtained and stored.

This digital sighting telescope allows only influences to be corrected that are due to the different ammunitions cannot correct further influences, in particular influences of the external environment, such as the distance between the weapon and the target.

From DE 42 18 118 C2 is known a sighting a telescope equipped with adjusting organs that is attached to a rifle, in particular a hunting rifle. In addition, a distance meter is used. The invention also provides that a processor connected to a distance meter via a measuring transducer is attached to the sighting telescope, which processor comprises a replaceable chip card on its input side, in which ballistic parameters of the bullet used are recorded, and which, on its output side, is connected to an adjustment motor of the adjusting organ for effecting a vertical change of the sighting optics and to an adjustment motor of the adjusting organ for effecting a lateral change of the sighting optics.

As before, the re-adjustment proceeds by means of two adjustment motors of this known sighting telescope which necessitates a very high mechanical effort and leads to a high sensitivity to external mechanical influences.

From U.S Pat. No. 6,449,892 B1 is known a weapon, a rifle in this case, having a sighting mechanism having the features mentioned above. In this known rifle that is equipped with a computer, it is essential that additional information and communication options are to be provided to the marksman to support him during a mission. However, the sighting mechanism in this case disadvantageously comprises but a single sighting optics that is directed to be parallel to the barrel of the weapon and that is combined with a camera. Combination with a night-viewing device is also possible, if needed. The recorded image is displayed on a screen within the sighting field of the marksman. Processing of the image is not carried out in this context. Moreover, it is evident from this printed specification that data from the global positioning system (GPS), from a laser distance meter and from an azimuth and aiming height sensor is entered into the computer and used by the computer to calculate the coordinates of a selected target relative to the position of the sighting mechanism and weapon. These target coordinates are then displayed by the computer of the weapon on a display such as to be visible to the marksman. By this means, the marksman receives readable information that supports him in the process of aiming. However, the marksman must analyze and assess the data displayed to him himself and draw his own conclusions from the data displayed, i.e. in particular he must change the direction of the weapon accordingly. In order to adequately process the target coordinates or other information displayed to him, the marksman must be well trained and experienced in order to avoid making errors. It is another disadvantage that the quality of the image recorded by the camera that is displayed on the screen deteriorates, in particular, with the increasing target distances, which makes the aiming more difficult for the marksman.

From U.S. Pat. No. 5,675,112 A is known a weapon with a corresponding sighting mechanism that utilizes two cameras. A first camera is arranged on the barrel of the weapon and its lens is directed at a marksman operating the weapon. A second camera is situated on a piece of equipment worn by the marksman, in particular a helmet, and directed at the target area. In this context, the cameras are directed such that each camera is within the area of recording of the corresponding other camera. A corresponding computer calculates a trajectory of the weapon from the data delivered by the two cameras and displays it optically on a screen that is situated within the sighting field of the marksman and displays only the image of the target area recorded by the second camera. It is considered to be disadvantageous that the image recorded by the camera gradually deteriorates with increasing shooting distances, which makes aiming more difficult, in particular over large distances. Moreover, no clues are provided herein as to how to take into account environmental parameters that influence the trajectory of the discharged projectile from outside. Accordingly, the sighting mechanism described in this document provides optical support to the marksman in the process of aiming in that a trajectory is optically displayed to the marksman, but high hitting accuracy, in particular at larger shooting distances, cannot be attained with this.

SUMMARY OF THE INVENTION

It is therefore the an object of the present invention to create a sighting mechanism that avoids the disadvantages referred to above and ensures very high hitting precision even over long and very long shooting distances, whereby both influences on the trajectory of the projectile from the external environment and from the discharged ammunition and/or influences originating from the weapon are accounted for reliably and whereby the handling of the sighting mechanism and of the weapon by a marksman shall be as simple as possible.

This object is met according to the invention by a sighting mechanism of the type mentioned above, that is characterized in that at least two digital video cameras are arranged on the weapon such as to be parallel to each other, and record the same target sighting field, in that the digital computer unit has at least two video input interfaces for digital image data of the video cameras, in that the digital computer unit comprises an image processing computer that allow at least a selectable image portion of the image data received from the video cameras to be superimposed in a pixel precise fashion and in real-time to form a target image and to be displayed on the screen, and in that the digital computer unit comprises a ballistics computer that can be used to position the target image displayed on the screen and a graticule that is either faded into said target image or situated on the screen with respect to each other in an automatic manner and in real time according to the data that is incoming through the input interfaces such that the position of the graticule in the target image coincides with a real point of impact of the projectile on the target.

The sighting mechanism according to the invention allows for very high hitting accuracy since the at least two parallel digital video cameras and the pixel precise digital image superimposition n real time provide for very high image quality at high resolution and low thermal and digital noise levels and low pixel noise levels and thus yield a very high quality real image of the target. Moreover, virtually all parameters influencing the trajectory of the projectile are captures and processed digitally to obtain a correction that automatically positions the graticule and the image of the target on the video screen relative to each other in an exact fashion. The marksman operating the weapon can therefore be as sure as possible that the discharged projectile actually hits the target point marked on the video screen by the graticule at the time the shot is fired, even when the shooting distances are large. Combining two or more parallel digital video cameras allows not only for superimposition of the imagers recorded, which significantly improves the image quality, but also provides for larger width of the field of view that is displayed for the marksman on the video screen. The video screen in the sighting field of the marksman jointly shows the target as a real image and the graticule in a clearer display. The marksman advantageously has not need to interpret, assess, and analyze data displayed to him, but rather can focus solely on aiming, since the correction of the position of the graticule relative to the target image is carried out automatically. In this context, the target and the graticule are optically visualized significantly better and simpler as compared to a view through a sighting telescope. The digital distance meter delivers exact data concerning the distance to be traveled by the projectile. The sensors for detecting measureable environmental parameters are used to detect the influences of the external environment on the trajectory of the projectile. Correction values are assigned to the detected values of the environmental parameters and used for automatic digital correction of the position of the graticule relative to the image of the target on the video screen. The biometric sensor for recognition of a marksman operating the weapon ensures that it can be determine unequivocally who is operating the weapon. The at least one firmly integrated or replaceable memory module allows to ensure, on the on hand, that only authorized marksmen can use the weapon. On the other hand, the at least one memory module, optionally a second memory module, can be used to transfer information relating to a certain ammunition to the computer unit of the sighting mechanism in order to provide specific data that are characteristic for certain ammunition and influence the trajectory of the projectile for correction of the graticule. This information includes, in particular, information provided by a manufacturer of the respective ammunition of which is obtained from shooting tests. The digital computer unit integrated into the sighting mechanism processes the incoming data and uses it to calculate the position of the graticule relative to the image of the target on the video screen such that the real point of impact of the projectile on the target coincides with the position of the graticule on the image of the target on the screen. The marksman operating the weapon can therefore fully rely on the image on the screen and does not need to correct the direction of the weapons based on his own experience or his own perception of environmental parameters. Accordingly, the hitting accuracy, for example of a rifle, in particular for long shot distances of 1000 m and more, can be significantly improved and optimized as compared to previously known sighting mechanisms. Since no mechanical adjustment or adjustment by motor(s) of parts of the sightings mechanism is required, the mechanical effort is advantageously kept relatively low which has cost-saving effects and reduce the sensitivity to wear and tear and damage. The sighting mechanism can advantageously be used on different weapons or weapons system, e.g., on rifles, grenade launchers, gun carriages, cannons or tanks.

Moreover, the invention advantageously provides for the digital cameras to each comprise a digital and/or optical zoom that are synchronized to each other. This allows the corresponding sighting field to be optimally set in dependence on the target distance.

The digital video cameras advantageously provide for different options with regard to the recorded images. A first embodiment considers that video images with identical spectral ranges can be recorded by the video cameras.

Alternatively, it is feasible to record video images with different spectral ranges using the video cameras.

In order for the marksman to see a well visualized image, it is preferred that at least one of the video cameras can record a video image in the visible spectral range.

Moreover, it is also feasible that a video image can be recorded as a thermal image in the infrared spectral range using at least one of the video cameras. After appropriate conversion of the image into visible colors, this allows to obtain addition target information that cannot be detected or is more difficult to detect in the visible spectral range.

In order for the sighting mechanism not to be dependent on natural or artificial light, at least one of the video cameras can be provided as a night-viewing device or coupled to a night-viewing device, whereby a video image can be recorded as a night-viewing image using this video camera. This allows the sighting mechanism to fulfill its function even in darkness.

In order to be able to adapt the sighting mechanism to the current operation conditions as rapidly as possible, the invention provides that the spectral range of recording of the video cameras can be switched or re-fitted.

In order for the sighting mechanism to be usable as flexibly and variably as possible, a further embodiment proposes that it is a mechanism that can be connected to the weapon or partly to the weapon and partly to the marksman operating the weapon such as to be detachable, and/or replaceable.

The digital distance meter preferably is a laser or infrared or radar distance meter, since these provide good measuring accuracy and allow for digital output of their measured data to the computer unit.

The invention preferably provides that the at least one sensor for the detection of measurable environmental parameters is designed for the detection of wind direction, wind velocity, air temperature, air pressure and/or air humidity. Depending on the number and type of parameters to be detected, one or more sensors that transfer their measured data to the computer unit may be used in this context.

The sensor for the detection of a measureable cartridge and/or weapon parameter preferably is designed for the detection of a cartridge temperature and/or barrel temperature of the weapons, since these parameters have the relatively largest impact on the trajectory of the projectile amongst the variable ammunition and/or weapon parameters. Again, correction values are assigned to the detected temperature in the computer unit ballistics computer and used for the correct positioning of the graticule relative to the image of the target on the screen.

In order to render any misuse of the sighting mechanism according to the invention and of a weapon equipped with same even more difficult, the invention provides for the encryption of the biometric data to be a digital-cryptic encryption.

Any normal or conventional ammunition matching the caliber of the weapon can be discharged with the weapon equipped with the sighting mechanism according to the invention. One further development for further expansion of the application range of the sighting mechanism proposes that it comprises an interface for the transmission of data from the computer unit to a "smart" projectile, in particular a guidable rocket or propellant projectile, that is provided with a suitable interface. By this, route, a guidable projectile can be provided with data that is as current as possible, whereby the projectile can then self-correct its trajectory even after its discharge.

A preferred measure for preventing misuse of the sighting mechanism and its corresponding weapon consists includes of the sighting mechanism comprising a locking mechanism that locks at least one function of the sighting mechanism and/or weapon that is required for discharging a shot, when the biometric sensor detects that the marksman handling the weapon and the marksman/marksmen stored in the memory module are not identical. The locking mechanism can for example effect that the digital computer unit shuts down its function or that a trigger of the weapon is locked.

Another further development proposes that the biometric sensor is a finger or thumbprint sensor that is arranged on a handle piece of operating handle of the weapon. In this context, the biometric sensor is situated in a position, in which it necessarily contacts the fingers or thumb of a marksman operating the weapon. Consequently, no special handling steps are required in order to perform the biometric test on the marksman.

Moreover, the sighting mechanism according to the invention can comprise a receiver for a satellite-based position determination (GPS receiver). This provides for the option that the digital computer unit determines, on the one hand, the position of the sighting mechanism and its corresponding weapon and, on the other hand, the position of a target relative to the former in the form of geographic coordinates.

A further development provides that positional data of the target calculated in the computer unit can be transmitted tot eh "smart" projectile via the interface between the computer unit and the projectile. This creates the option that the projectile self-corrects on its flight based on the positional data of the target entered and thus reaches its intended target at high hitting accuracy.

In this context, the interface between the computer unit and the projectile can, for example, be a "Bluetooth" interface. On the one hand, an interface of this type is proven technology and, on the other hand, it requires little space and technical effort such that it can be used particularly well for the purpose desired in this context.

Moreover, the invention provides the sighting mechanism such that it comprises a data and/or an mage recording unit, in which each use of the sighting mechanism and of the corresponding weapon can be stored, and in that it comprises an output interface for time-synchronous or time-delayed output of the data and/or images to the video screen of the sighting mechanism and/or to an external unit for storage and/or display of data and/or images. This further development provides for the option to document data and/or images and thus save them for evidentiary purposes. This is of importance in particular if the weapon, in particular a rifle, is used during police missions.

In order to provide for safe and malfunction-free operation, it is preferably provided that the sighting mechanism according to the invention comprises an internal electrical power supply in the form of a battery or a storage battery and/or a fuel cell and/or cell arrangement and/or in that it comprises a connection for an external electrical power source. In the case of an internal electrical power supply, the sighting mechanism can be operated autonomously at least for a certain period of time. Operating conditions permitting, use can be made alternatively or in addition of an external power supply which then avoids restrictions with regards to the time of operation.

In order to prevent, to the extent possible, dangerous errors of the marksman and errors of others that are dangerous to the marksman, the sighting mechanism can have or comprise a friend-foe recognition system with a wireless signal transmission.

Upon the discharge of shots, a weapon exerts substantial mechanical forces on parts connected to it, in the present case on the sighting mechanism, because of its recoil. In order to ensure that these forces do not lead to premature failure of the sighting mechanism, it is proposed that the sighting mechanism is provided to be shot-proof with regard to the shots of its corresponding weapon and ensuring vibrations thus caused and in that a vibration-proof design and/or vibration-proof bearing of the parts of the sighting mechanism is provided for this purpose.

It is also important that the sighting mechanism cannot be taken out of operation prematurely by enemy influence, e.g., by coming under enemy fire. For this purpose, it is proposed that the sighting mechanism is provided to be shot proof with regard to projectiles hitting it from outside and in that, for this purpose, at least an armoring taking up or surrounding the parts of the sighting mechanism is provided. For weight reasons, the armoring preferably consists of plastics, e.g., PTFE.

In the manufacture of the sighting mechanism according to the invention, a reduction of the unit cost can be achieved by manufacturing as many identical sighting mechanisms as possible. A contribution to this aim is made by a preferred embodiment of the invention providing that the same embodiment of the invention can be used on various types of weapon or weapon systems and can be moved from a weapon or weapon system of a first type to a weapon or weapon system of a second type without having to make changes. This allows for very high flexibility in operation. The only requirement in this case is updating of the data in digital form, in particular by selecting the specific data of the respective assigned weapon and its ammunition being from a set of data that has already been stored or inputting said data into the computer unit of the sighting mechanism, e.g., by means of a replaceable memory module or via an interface from a suitably equipped computer.

BRIEF DESCRIPTION OF THE DRAWINGS

One exemplary embodiment of the invention is illustrated in the following by means of a drawing.

DETAILED DESCRIPTION OF THE PREFERRED EMBODIMENT

Figure 1:
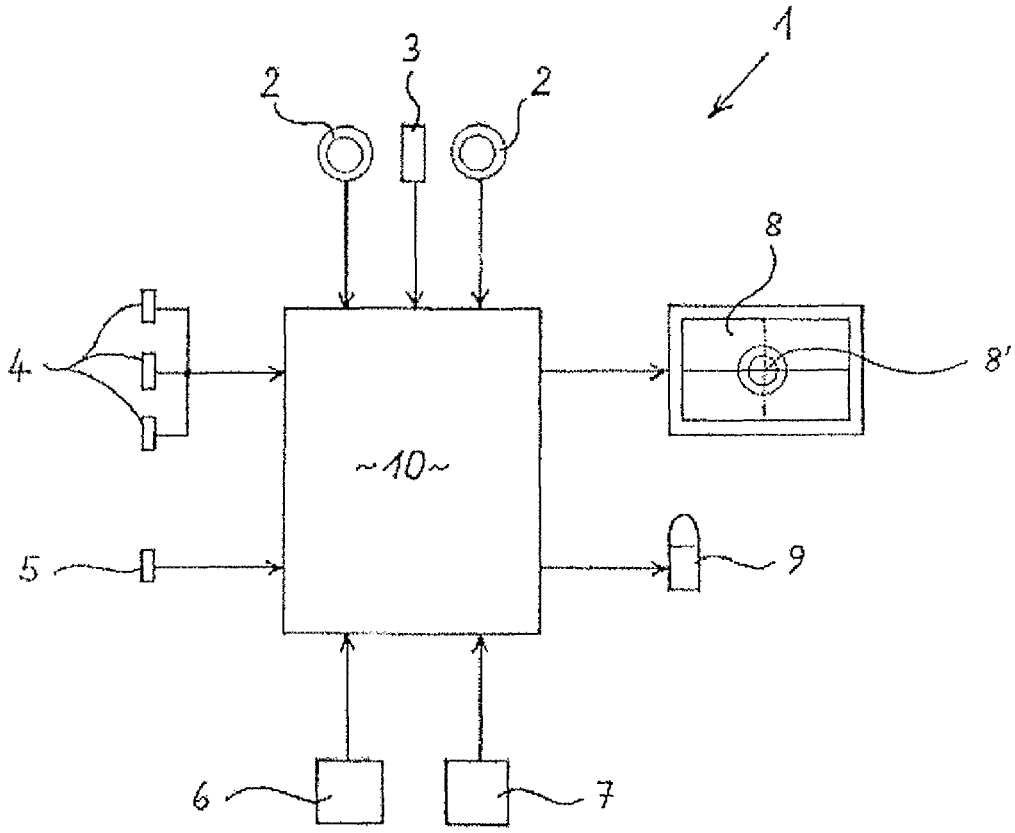
FIG. 1 shows a schematic diagram of a sighting mechanism according to the invention.
Figure 2:
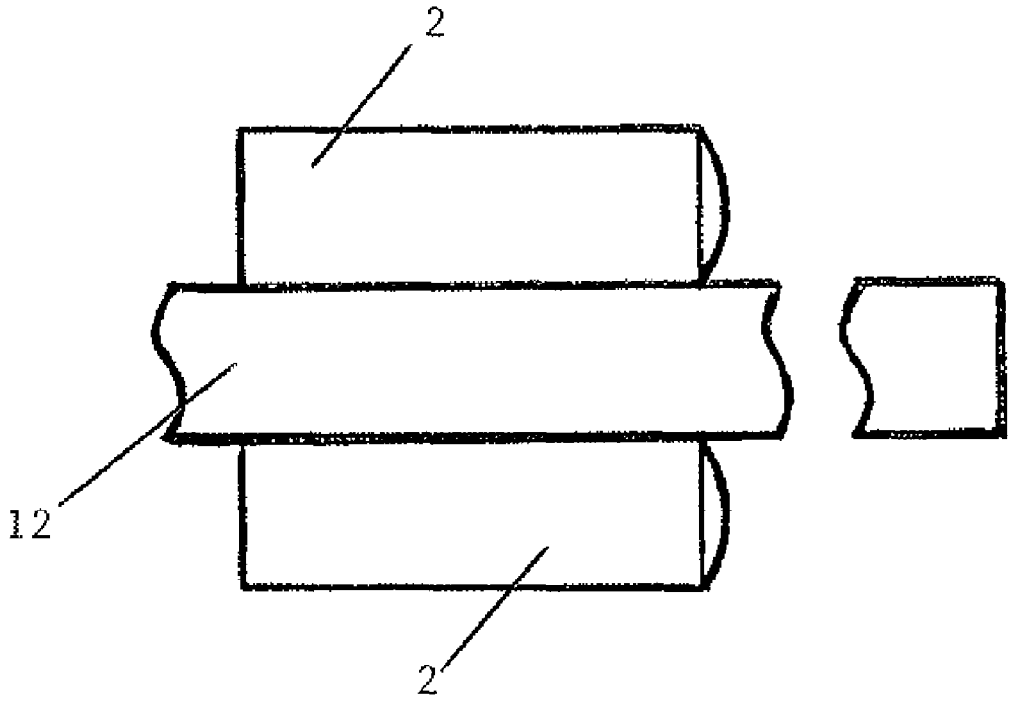
FIG. 2 shows a schematic partial plan view of two digital video cameras arranged on a firearm barrel.

The sighting mechanism 1 that is shown schematically in FIG. 1 of the drawing comprises multiple components that are connected to a central digital computer unit 10 either electrically by cable or wireless. The sighting mechanism 1 and its components are jointly attached to a weapon that is partially and schematically shown in FIG. 2, or they are integrated into that weapon. Alternatively, the parts of the sighting mechanism can also be attached to or arranged on partly the weapon and partly a marksman operating the weapon, whereby the parts again are in communication contact with each other either by cable or wireless.

The top part of FIG. 1 shows two digital video cameras 2 that are arranged parallel to each other and are attached, for example, to the barrel 12 (FIG. 2) of a corresponding weapon and simultaneously record the same target area. The video cameras 2 are connected to the computer unit 10 by means of a suitable input interface each. Accordingly, the cameras 2 synchronously deliver two images of an aimed-for target, whereby at least portions of the images are digitally superimposed in the computer unit 10 in a pixel precise fashion and in real time in order to improve the image quality and accuracy. This digital superimposition of the images significantly reduces the thermal and digital image noise level as well as the so-called pixel noise level. Accordingly, a good and clear image of the target is attained even if the target distance is large.

Moreover, the sighting mechanism 1 comprises a distance meter 3 that also operates in a digital fashion and also delivers its distance measuring data to the computer unit 10.

Sensors 4 and 5 are shown in the left part of FIG. 1. The sensors 4 server for detection of environmental parameters influencing the trajectory of a projectile discharged by the corresponding weapon. These parameters include, in particular, wind direction, wind velocity, air temperature, air pressure, and air humidity. In this context, the further sensor 5 is at least one temperature sensor that can be used to measure and transmit to the computer unit 10 the temperature of a cartridge that is situated in the corresponding weapon and intended to be used for the shot and/or the temperature of the barrel of the corresponding weapon.

A further sensor 6 and a memory module 7 are indicated in the lower part of the drawing of FIG. 1. The sensor 6 is a biometric sensor serving to identify a marksman using the sighting mechanism and the corresponding weapon and to check whether or not said marksman is authorized to use the corresponding sighting mechanism and weapon.

The memory module 7 serves for storing biometric data of authorized users of the sighting mechanism 1 and corresponding weapon and for transmitting said data to the computer unit 10 in order to carry out a comparison to the biometric data recorded by means of the sensor 6. If these conform, the sighting mechanism 1 and/or the corresponding weapon are released for use; if they do not confirm, locking is effected that renders the sighting mechanism 1 and/or the corresponding weapon unusable.

The same memory module 7 or, if applicable, a different memory module contains information concerning the ammunition to be discharged by the corresponding weapon in the particular case, in particular ammunition parameters that influence the trajectory of the projectile. This information is provided, for example, by a manufacturer of ammunition or its is obtained through shooting tests. Depending on the ammunition that is used, the matching memory module 7 is then connected to the computer unit 10 or a matching set of data is selected from the memory module 7 or from a separate further memory module or a memory module that is integrated into the computer unit 10 such that it is fixed therein. The memory module 10 can be fixed integrated memory; alternatively, it can be a replaceable memory that is connected mechanically by means of a plug-in connection or electrically to the computer unit 10 in a detachable fashion.

Moreover, the sighting mechanism 1 comprises a video screen 8 that displays the image of the target recorded by the cameras 2 and superimposed by the computer unit 10 such that the marksman has a good view of it. A graticule 8' is faded into the screen 8 or fixed place on screen 8. Taking into consideration the data received from the distance meter 3, sensors 4, 5, and 6, and memory module 7, the computer unit 10 ensures that the relative positions of the image of the target seen on the screen 9 and of the graticule 8' are automatically corrected such that a real point of impact of a discharged projectile coincides with the point of the target seen on the screen 8 that is marked by the graticule 8'.

And lastly, the sighting mechanism 1 shown in this example is also provided with an interface that can be used to transfer data from the computer unit 10 to a so-called "smart" projectile 9. This projectile 9 is a projectile that is provided with its own guidance data memory and guidance option such that the projectile 9 can correct its trajectory even after it is discharged.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A sighting mechanism for a firearm, comprising:

at least two digital video cameras arranged on a firearm parallel to its barrel and to each other which record a same target sighting field, a video screen arranged in a sighting field of a marksman operating the firearm and arranged to display a target image that is recorded by the video cameras, a digital target distance meter, at least one sensor arranged to detect measurable environmental parameters, at least one sensor arranged to detect at least one of measurable cartridge and weapon parameters, at least one memory module, in which ammunition data of ammunition that can be discharged by the firearm is stored; and a digital computer unit having at least two video input interfaces for digital image data of the video cameras, for the distance meter, for the sensors, and for the memory module, and having an output interface for the video screen, whereby, aside from the target image recorded by the video cameras, the video screen displays an information for the marksman that supports the aiming and is calculated by the computer unit as a function of the data that is incoming by means of the input interfaces, the digital computer unit comprises an image processing computer that allows at least a selectable image portion of the image data received from the video cameras to be superimposed in a pixel precise fashion and in real-time to form a target image and to be displayed on the screen, and the digital computer unit comprises a ballistics computer that can be used to position the target image displayed on the screen and a graticule that is either faded into said target image or situated on the screen with respect to each other in an automatic manner and in real time according to the data that is incoming through the input interfaces such that the position of the graticule in the target image coincides with a real point of impact of a projectile from the firearm on the target.

2. The sighting mechanism according to claim 1, wherein the video cameras each comprise one of a digital and/optical zoom with the zooms being synchronized to each other.

3. The sighting mechanism according to claim 1, wherein the video cameras are arranged to record video images with one of identical and different spectral ranges.

4. The sighting mechanism according to claim 3, wherein at least one of the video cameras is arranged to record a video image in the visible spectral range.

5. The sighting mechanism according to claim 3, wherein at least one of the video cameras is arranged to record a video image in the infrared range as a thermal image.

6. The sighting mechanism according to claim 3, wherein at least one of the video cameras is arranged to record a night-viewing image via a night-viewing device.

7. The sighting mechanism according to claim 3, wherein the video cameral arranged to permit the spectral ranges to be recorded is at least one of switched and re-fitted.

8. The sighting mechanism according to claim 1, wherein the sighting mechanism is connected to one of the weapon alone and partly to the weapon and partly to the marksman operating the weapon, wherein the sighting mechanism is also at least one of detachable and replaceable.

9. The sighting mechanism according to claim 1, wherein the digital distance meter is one of a laser, an infrared and a radar distance meter.

10. The sighting mechanism according to claim 1, wherein the at least one sensor arranged to detect measurable environmental parameters is a sensor arranged to detect at least one of wind direction, wind velocity, air temperature, air pressure and air humidity.

11. The sighting mechanism according to claim 1, wherein the at least one sensor arranged to detect at least one of a measurable cartridge and weapon parameter is arranged to detect at least one of a cartridge temperature and a barrel temperature of the weapon.

12. The sighting mechanism according to claim 1, further comprising an interface for a transmission of data from the computer unit to a "smart" projectile, in the form of a guidable rocket or propellant projectile, having a suitable interface.

13. The sighting mechanism according to claim 12, further comprising a transmitter unit arranged to transmit positional data of the target calculated in the computer unit to the "smart" projectile via the interface between the computer unit and the projectile.

14. The sighting mechanism according to claim 13, wherein the interface between the computer unit and the projectile is a "bluetooth" interface.

15. The sighting mechanism according to claim 1, further comprising a receiver for a satellite-based position determination.

16. The sighting mechanism according to claim 1, further comprising at least one of a data and an image recording unit, in which each use of the sighting mechanism and of the corresponding weapon can be stored, and an output interface for one of time-synchronous and time-delayed output of at least one of the data and images to at least one of the video screen of the sighting mechanism and to an external unit for at least one of storage and display of at least one of data and images.

17. The sighting mechanism according to claim 1, further comprising at least one of a connection for an external electrical power source and an internal electrical power supply in the form of at least one of a battery, a storage battery, a fuel cell and a solar cell arrangement.

18. The sighting mechanism according to claim 1, further comprising a friend-foe recognition system with a wireless signal transmission.

19. The sighting mechanism according to claim 1, comprising one of a vibration-proof design and a vibration-proof bearing rendering the sighting mechanism shot-proof with regard to the shots of its corresponding weapon and ensuing vibrations thus caused.

20. The sighting mechanism according to claim 1, further comprising an armoring one of taking up and surrounding the parts of the sighting mechanism to render the sighting mechanism shot-proof with regard to projectiles hitting it from outside.

21. The sighting mechanism according to claim 1, wherein the sighting mechanism is arranged to be used on various types of weapon and weapon systems and is movable from a weapon or weapon system of a first type to a weapon or weapon system of a second type without having to make changes to the sighting mechanism.

22. The sighting mechanism according to claim 1, further including at least one biometric sensor arranged to recognize a marksman handling the firearm and at least one memory module in which encoded biometric data of at least one authorized marksman is stored.

23. The sighting mechanism according to claim 22, wherein the encryption of the biometric data comprises a digital-cryptic encryption.

24. The sighting mechanism according to claim 22 further comprising a locking mechanism that locks at least one function of at least one of the sighting mechanism and weapon that is required for discharging a shot, when the biometric sensor detects that the marksman handling the weapon and the encoded biometric data of at least one authorized marksman stored in the memory module are not identical.

25. The sighting mechanism according to claim 22, wherein the biometric sensor is one of a finger and thumbprint sensor that is arranged on a manually graspable handle portion of the weapon.

26. A sighting mechanism for a firearm, comprising;

at least two digital video cameras arranged on a firearm parallel to its barrel and to each other which record a same target sighting field, a video screen arranged in a sighting field of a marksman operating the firearm and displaying a target image that is recorded by the video cameras, a digital target distance meter, at least one sensor arranged to detect measurable environmental parameters, at least one sensor arranged to detect at least one of measurable cartridge and weapon parameters, at least one memory module, in which ammunition data of ammunition that can be discharged by the firearm is stored; and a digital computer unit having at least two video input interfaces for digital image data of the video cameras, for the distance meter, for the sensors, and for the memory module, and having an output interface for the video screen, whereby, aside from the target image recorded by the video cameras, the video screen displays an information for the marksman that supports the aiming and is calculated by the computer unit as a function of the data that is incoming by means of the input interfaces, the digital computer unit comprises an image processing computer that allows at least a selectable image portion of the image data received from the video cameras to be superimposed in a pixel precise fashion and in real-time to form a target image and to be displayed on the screen, and the digital computer unit comprises a ballistics computer that can be used to position the target image displayed on the screen and a graticule that is one of faded into the target image and situated on the screen with respect to each other in an automatic manner and in real time according to the data that is incoming through the input interfaces such that the position of the graticule in the target image coincides with a real point of impact of a projectile from the firearm on the target.

27. The sighting mechanism according to claim 26, further including at least one biometric sensor arranged to recognize a marksman handling the firearm and at least one memory module in which encoded biometric data of at least one authorized marksman is stored.

* * * * *